US009333544B2

(12) United States Patent
Hidaka et al.

(10) Patent No.: US 9,333,544 B2
(45) Date of Patent: May 10, 2016

(54) PLUG USED IN PIERCING MACHINE

(71) Applicant: NIPPON STEEL & SUMITOMO METAL CORPORATION, Tokyo (JP)

(72) Inventors: Yasuyoshi Hidaka, Tokyo (JP); Yasuto Higashida, Tokyo (JP); Kazuhiro Shimoda, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/396,100

(22) PCT Filed: Mar. 26, 2013

(86) PCT No.: PCT/JP2013/058866

§ 371 (c)(1),
(2) Date: Oct. 22, 2014

(87) PCT Pub. No.: WO2013/161489

PCT Pub. Date: Oct. 31, 2013

(65) Prior Publication Data

US 2015/0075243 A1 Mar. 19, 2015

(30) Foreign Application Priority Data

Apr. 24, 2012 (JP) ..... 2012-098919
May 9, 2012 (JP) ..... 2012-107275

(51) Int. Cl.

| | |
|---|---|
| ***B21B 28/00*** | (2006.01) |
| ***B05D 3/12*** | (2006.01) |
| ***B05D 1/02*** | (2006.01) |
| ***B21B 19/04*** | (2006.01) |
| ***B21B 25/00*** | (2006.01) |
| ***C23C 4/00*** | (2016.01) |

(52) U.S. Cl.
CPC . *B21B 28/00* (2013.01); *B05D 1/02* (2013.01); *B05D 3/12* (2013.01); *B21B 19/04* (2013.01); *B21B 25/00* (2013.01); *C23C 4/005* (2013.01)

(58) Field of Classification Search
CPC ..... B21B 28/00; B21B 25/00; B05D 1/02; B05D 3/12; C23C 4/125; C23C 4/105; C23C 4/08; B24C 3/32
USPC ..... 72/97, 47, 209, 208, 476; 427/142, 256, 427/287, 299, 427.3, 580; 428/547, 548, 428/469, 471
See application file for complete search history.

(56) References Cited

U.S. PATENT DOCUMENTS

| | | | | |
|---|---|---|---|---|
| 5,778,714 | A * | 7/1998 | Katsumura et al. | 72/97 |
| 2010/0050723 | A1* | 3/2010 | Hidaka et al. | 72/97 |
| 2015/0075241 | A1* | 3/2015 | Yamamoto et al. | 72/47 |
| 2015/0140208 | A1* | 5/2015 | Higashida et al. | 72/97 |

FOREIGN PATENT DOCUMENTS

| | | |
|---|---|---|
| CN | 101848777 | 9/2010 |
| CN | 102284777 | 12/2011 |
| JP | 09-29310 | 2/1997 |
| JP | 2776266 | 7/1998 |
| JP | 4279350 | 6/1999 |
| JP | 3891679 | 3/2007 |
| JP | 2009-101408 | 5/2009 |

* cited by examiner

*Primary Examiner* — David B Jones
(74) *Attorney, Agent, or Firm* — Clark & Brody

(57) ABSTRACT

To increase the life of a plug used in a piercing machine for piercing-rolling a billet. The plug (10) is used in a piercing machine (30) that piercing-rolls a billet (36). The plug (10) includes a plug body (12), a build-up layer (14), and a sprayed film (16). The build-up layer (14) is formed on a surface of the plug body (12). The sprayed film (16) covers at least an area ranging from the rear end of the build-up layer (14) to a position of the maximum outer diameter of the plug body (12).

4 Claims, 4 Drawing Sheets

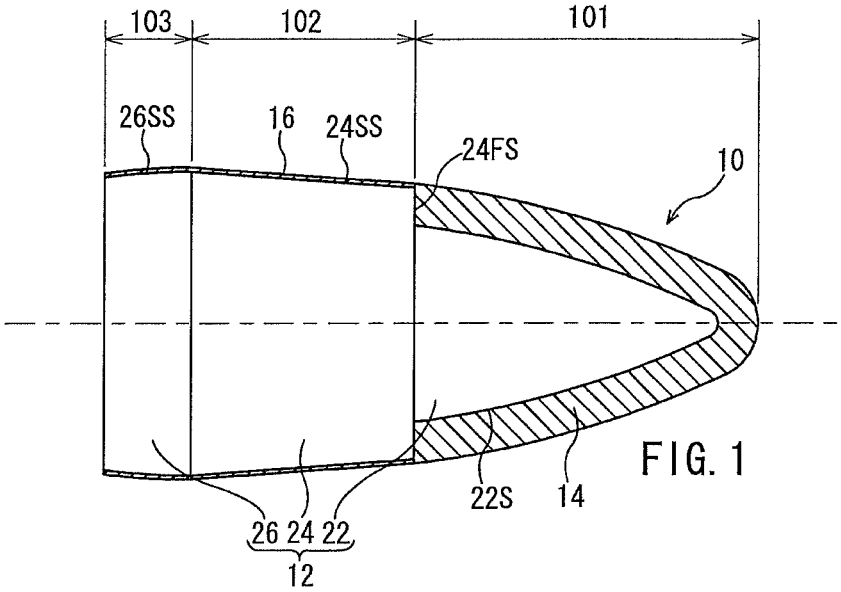
FIG. 1
FIG. 2
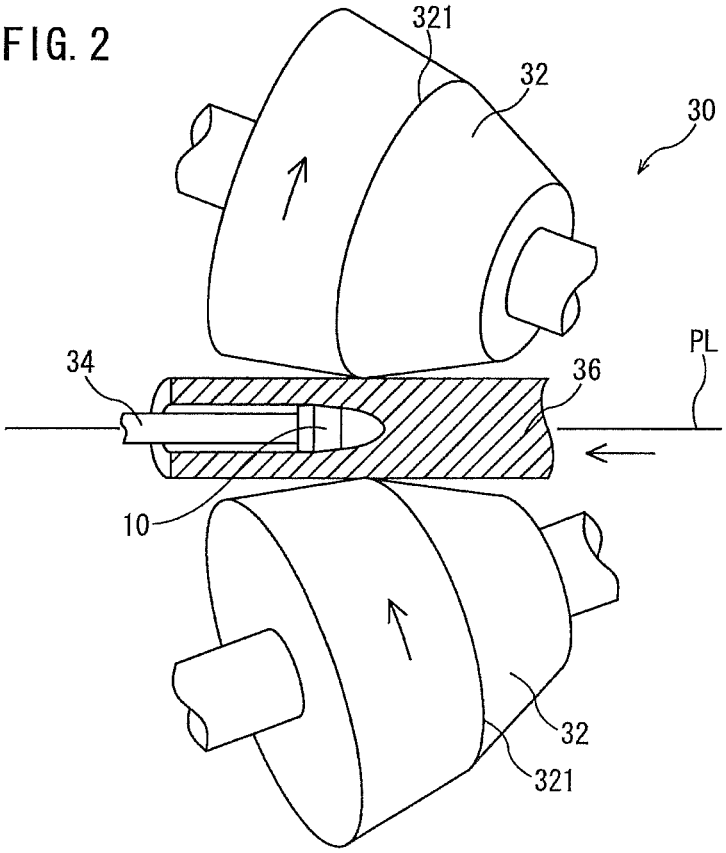

PLUG USED IN PIERCING MACHINE

TECHNICAL FIELD

The present invention relates to a plug, and more specifically to a plug for use in a piercing machine for piercing-rolling a billet.

BACKGROUND ART

A piercing machine is used for the production of seamless steel pipes in the Mannesmann process. A piercing machine includes a pair of skew rolls and a plug. The plug is disposed between the pair of skew rolls and is on a pass line. The piercing machine pushes and squeezes a billet over the plug while rotating it in the circumferential direction by means of the skew rolls to piercing-roll the billet into a hollow blank.

The piercing machine piercing-rolls a heated billet. As a result, the plug over which the billet is squeezed is exposed to high temperature and is subjected to high pressure. Therefore, the plug is susceptible to melting loss and scoring.

Generally, an oxide scale is formed on the surface of the base metal of the plug. The oxide scale blocks the heat from the billet thereby suppressing the occurrence of melting loss. The oxide scale further suppresses the occurrence of scoring.

However, the oxide scale will wear every time the plug piecing-rolls a billet. When the oxide scale is lost, the temperature of the base metal of the plug will rise, resulting in a melting loss of the plug.

To improve the life (number of uses) of the plug, forming a coating other than an oxide scale on the surface of the base metal of the plug is proposed.

JP4279350B discloses the forming of a sprayed film made up of oxides and Fe by arc spraying an iron wire rod on the surface of the base metal of the plug.

Further, JP2776266B, JP3891679B, and JP2009-101408A disclose the forming of a build-up layer on the surface of the base metal of the plug.

DISCLOSURE OF THE INVENTION

However, in recent years, there is a need for further increasing the life of the plug.

It is an objective of the present invention to provide a plug for use in a piercing machine for piercing-rolling a billet, the plug having an extended life.

A plug according to embodiments of the present invention is used in a piercing machine for piercing-rolling a billet. The plug includes a plug body, a build-up layer, and a sprayed film. The build-up layer is formed on a surface of the plug body. The sprayed film covers at least an area ranging from the rear end of the build-up layer to a position of the maximum outer diameter of the plug body out of the surface of the plug body.

The plug according to embodiments of the present invention will have an extended life.

BRIEF DESCRIPTION OF THE DRAWINGS

FIG. 1 is a longitudinal sectional view of a plug according to a first embodiment of the present invention;

FIG. 2 is a schematic diagram showing the configuration of a piercing machine in which the plug shown in FIG. 1 is used;

DESCRIPTION OF EMBODIMENTS

Figure 3:
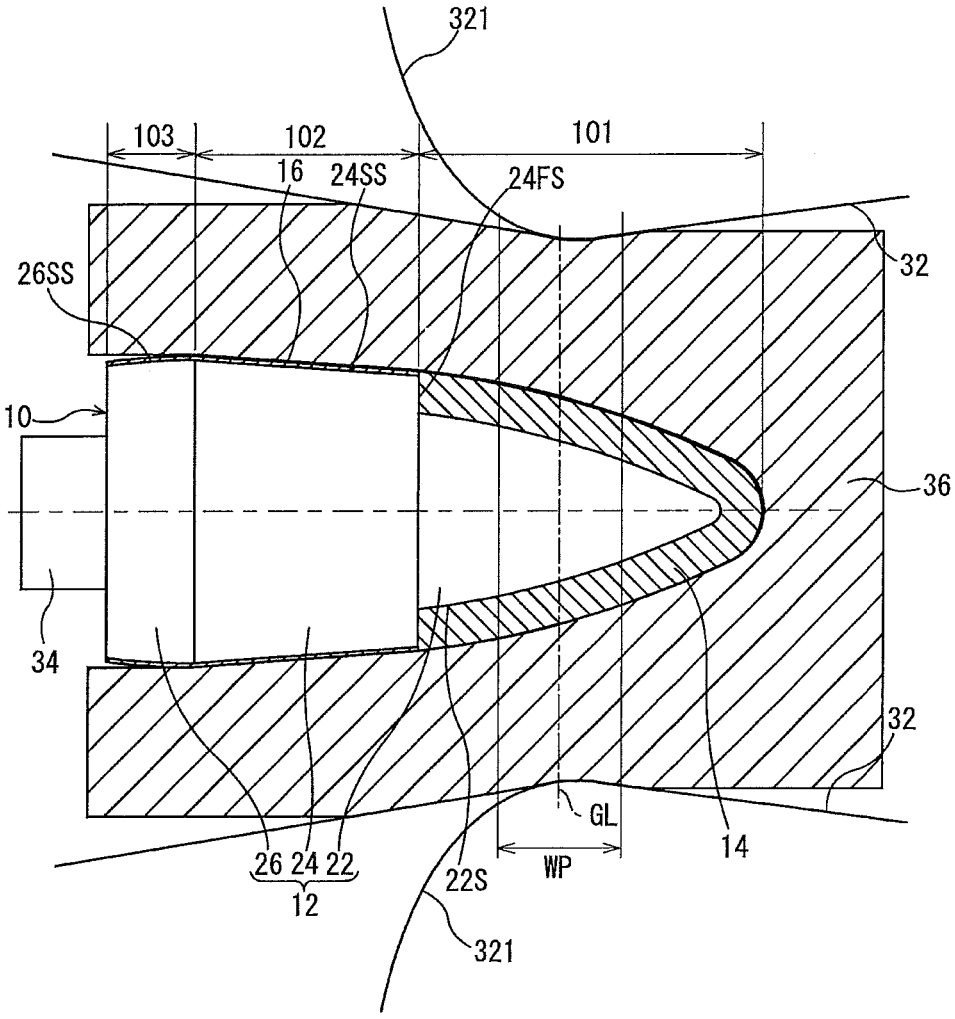
FIG. 3 is a schematic diagram showing the relationship between a build-up layer of the plug and a gorge portion of a skew roll in FIG. 2.

A plug according to embodiments of the present invention is used in a piercing machine for piercing-rolling a billet. The plug includes a plug body, a build-up layer, and a sprayed film. The build-up layer is formed on a surface of the plug body. The sprayed film covers at least an area ranging from the rear end of the build-up layer to a position of the maximum outer diameter of the plug body out of the surface of the plug body.

At the time of piercing-rolling of the billet, the plug body comes in contact with the billet; thus, the plug body is susceptible to melting loss. This portion susceptible to melting loss is provided with a build-up layer which has a high hot strength. Thereby, the hot strength of the plug body increases. Consequently, the plug body becomes less susceptible to melting loss.

Meanwhile, forming a build-up layer on the entire surface of the plug will cause scoring more likely to occur. Accordingly, in the plug according to the present embodiment, a sprayed film is formed on the side surface of the plug. The sprayed film has a more excellent resistance to scoring than the build-up layer. Therefore, the plug according to the present embodiment, the build-up layer suppresses melting loss and the sprayed film suppresses scoring. Consequently, the life of the plug increases.

Preferably, the build-up layer covers the front end portion of the plug body. If a solid billet is piercing-rolled, the front end portion of the plug body contacts the billet. Thus, the front end portion of the plug body is susceptible to melting loss. This portion, susceptible to melting loss, is covered with a build-up layer; As a result, the front end portion of the plug is less susceptible to melting loss.

Preferably, the plug body includes a first body portion and a second body portion. The first body portion includes the front end portion. The second body portion has an outer diameter larger than that of the rear end of the first body portion, and extends from the rear end of the first body portion. The build-up layer is formed on the surface of the first body portion. The sprayed film is formed on the surface of the second body portion.

In such a case, even if the build-up layer is formed to be thicker than the sprayed film is, it becomes less likely that a step height at the boundary between the build-up layer and the sprayed film is formed.

Preferably, the plug body includes a first body portion and a second body portion. The first body portion includes the front end portion of the plug body. The second body portion extends from the rear end of the first body portion. The build-up layer is formed on the surface of the second body portion.

In this case, the plug may be used to piercing-roll a hollow billet, for example.

Preferably, the plug body further includes a third body portion. The third body portion extends from the rear end of the second body portion. The outer diameter of the front end of the second body portion is smaller than the outer diameter of the rear end of the first body portion. The third body portion has an outer diameter larger than that of the rear end of the second body portion. The sprayed film is formed on the surface of the third body portion.

In this case, between the first body portion and third body portion, a bottom surface is formed by the surface of the second body portion, and a recess groove extending around the central axis of the plug body is formed. The build-up layer is located in this recess groove. As such, even if the build-up layer is thicker than the sprayed film, a step height is unlikely to be formed at the boundary between the build-up layer and the sprayed film.

Preferably, the surface of the build-up layer and the surface of the sprayed film connect to each other in a smooth fashion. In such a case, since there is no step height produced at the boundary between the build-up layer and the sprayed film, it becomes less likely that flaws occur in the inner surface of a hollow blank after piercing-rolling.

Preferably, the build-up layer contains carbides. In such a case, the hot strength of the build-up layer will further increase.

Hereafter, the plug according to embodiments of the present invention will be described with reference to the drawings. The like or corresponding parts in the drawings are given the like reference characters so that the description thereof will not be repeated.

First Embodiment

FIG. 1 is a longitudinal sectional view of a plug 10 according to a first embodiment of the present invention. The plug 10 may be used to piercing-roll a solid billet, for example. As shown in FIG. 1, the plug 10 includes a plug body 12, a build-up layer 14, and a sprayed film 16.

[Plug Body]

The plug body 12 includes a first body portion 22, a second body portion 24, and a rear end portion 26.

The first body portion 22 includes a front end portion of the plug body 12. The cross-section of the first body portion 22 is of a circular shape. The outer diameter of the first body portion 22 increases from the front end toward the rear end of the plug 10.

The second body portion 24 has an outer diameter larger than that of the rear end of the first body portion 22. The second body portion 24 extends in the axial direction of the plug 10 from the rear end of the first body portion 22.

The cross section of the second body portion 24 is of a circular shape, and the outer diameter of the front end of the second body portion 24 is larger than the outer diameter of the rear end of the first body portion 22. The second body portion 24 is disposed coaxially with the first body portion 22. As a result, a step height will be formed at the boundary between the second body portion 24 and the first body portion 22. A front end surface 24FS of the second body portion 24 has an annular shape.

The outer diameter of the second body portion 24 increases from the front end toward the rear end of the plug 10. The outer diameter of the rear end of the second body portion 24 is the maximum outer diameter of the plug body 12.

The rear end portion 26 is provided adjacent to the second body portion 24 at the rear side of the second body portion 24. The outer diameter of the rear end portion 26 decreases from the front end toward the rear end of the plug 10.

[Protection Film of Plug Body]

The above described plug body 12 is formed with protection films (a build-up layer 14 and a sprayed film 16) which are different between the front and rear portions thereof.

[Build-Up Layer]

The build-up layer 14 is formed on the surface of the plug body 12. The build-up layer 14 covers at least the front end portion of the plug body 12. In the example shown in FIG. 1, the build-up layer 14 covers the entire surface 22S of the first body portion 22 and the front end surface 24FS of the second body portion 24. The build-up layer 14 is formed by a well-known build-up welding such as, for example, a plasma transferred arc (PTA) welding process, a MIG (Metal Inert Gas) welding process, and a TIG (Tungsten Inert Gas) welding process. The thickness of the build-up layer 14 is, for example, not less than 1 mm. Preferably, the build-up layer 14 has a thickness of 1 to 20 mm, and more preferably 2 to 10 mm. If the thickness is to exceed 5 mm, a plurality of build-up layers may be formed, for example. Each layer has a thickness of 2 to 5 mm, for example. After a plurality of build-up layers are formed, the target entire thickness may be achieved by cutting away the surface of the topmost build-up layer. If the thickness is to be smaller than 2 mm, a build-up layer with a thickness of 2 mm or larger may be formed before the surface of the build-up layer is cut away to achieve the target thickness. If the build-up layer 14 is, too thin, the hot strength may not be improved. If the build-up layer 14 is too thick, the build-up layer 14 may develop a crack. Moreover, forming such a build-up layer 14 may require a longer time, leading to increased manufacturing costs. The thickness of the build-up layer 14 needs not necessarily be constant: For example, the front end portion of the build-up layer 14 may have a larger thickness than those of other portions. The outer diameter of the rear end of the build-up layer 14 is larger than that of the front end of the second body portion 24.

The build-up layer 14 is made of, for example, an alloy predominantly composed of a transition metal. An example of such an alloy is an alloy (Stellite Alloy) which is predominantly composed of cobalt (Co) and contains chromium (Cr) and tungsten (W).

The build-up layer 14 may contain a carbide of a transition metal. Examples of such carbide of a transition metal includes niobium carbide (NbC), tungsten carbide (WC), titanium carbide (TiC), vanadium carbide (VC), and chromium carbide (CrC). Such carbide of a transition metal is contained, for example, by 20% to 50% by volume. The average particle diameter of such carbide of a transition metal is, for example, 65 to 135 μm.

[Sprayed Film]

The sprayed film 16 covers at least an area ranging from the rear end of the build-up layer 14 to a position of the maximum outer diameter of the plug body 12. In the example shown in FIG. 1, the sprayed film 16 covers a side surface 24SS of the second body portion 24 and a side surface 26SS of the rear end portion 26. The sprayed film 16 is formed by a well-known spraying, for example, arc spraying, plasma spraying, flame spraying, and high-speed flame spraying. The thickness of the sprayed film 16 is, for example, 400 μm to 800 μm.

The composition of the sprayed film 16 is not specifically limited. Preferably, the sprayed film 16 is made up of iron (Fe) and iron oxides (for example, $Fe_3O_4$, FeO and the like). In such a case, the sprayed film 16 is formed, for example, by arc spraying an iron wire rod. The sprayed film 16 may further contain an oxide (for example, tungsten oxide ($WO_3$)) other than iron oxides.

Preferably, the proportion that iron oxides account for in the sprayed film 16 made up of iron and iron oxides is 55% to 80% by volume. The proportion that the iron oxides account for in the sprayed film 16 is, for example, higher on the side of the outer layer than on the side of the plug body 12. In this case, the proportion that iron oxides account for in the sprayed film 16 is, for example, not more than 40% by volume at a boundary portion with the plug body 12, and 55% to 80% by volume in the outer layer portion. To vary the proportion that iron oxides account for in the sprayed film 16, for example, the distance (spraying distance) from the spray nozzle of the arc spraying apparatus to the plug body 12 may be varied.

In the example shown in FIG. 1, the outer diameter of the front end of the sprayed film 16 is the same as that of the rear end of the build-up layer 14. That is, the surface of the build-up layer 14 and the surface of the sprayed film 16 connect to each other in a smooth fashion.

[Production Method for Plug]

An example of the production method for the plug 10 will be shown. However, the production method for the plug 10 will not be limited to the production method described below.

First, the plug body 12 is prepared. Next, the build-up layer 14 is formed on the surface 22S of the first body portion 22 by the PTA process. Next, shot blasting is performed on the area (the side surface 24SS of the second body portion 24 and the side surface 26SS of the rear end portion 26) to form the sprayed film 16. As a result of this, the surfaces are roughened, thereby facilitating the adhesion of the sprayed film 16. Next, the sprayed film 16 is formed on the area excepting the area in which the build-up layer 14 is formed of the side surface of the plug body 12, by arc spraying an iron wire rod. As a result of this, the plug 10 is produced.

FIG. 2 is a schematic diagram showing the configuration of a piercing machine 30 including the plug 10. In the piercing machine 30, the plug 10 is attached to the front end of a mandrel 34 and is disposed between a pair of skew rolls 32 and 32 and on a pass line PL. During piercing-rolling, the plug 10 is squeezed into a solid billet 36 and is exposed to high temperature and is subjected to high pressure.

The front end portion of the plug 10 is covered with the build-up layer 14. The build-up layer 14 has a higher hot strength than the sprayed film and the oxide scale. Therefore, the front end portion of the plug 10 becomes less susceptible to melting loss even when piercing-rolling the billet 36.

Further, the sprayed film 16 is formed on the side surface of the portion excepting the front end portion of the plug 10. The sprayed film has a higher scoring resistance than that of the build-up layer. Therefore, the plug 10 becomes less susceptible to scoring than in the case where the entire surface of the plug body 12 is covered with the build-up layer.

As described above, in the plug 10, melting loss of the front end portion is suppressed by the build-up layer, and scoring is suppressed by the sprayed film. Thus the life of the plug 10 will be extended.

Generally, the build-up layer is formed to be thicker than the sprayed film. In the plug 10, the outer diameter of the rear end of the first body portion 22 is smaller than that of the front end of the second body portion 24. Therefore, no step height is formed at the boundary between the surface of the build-up layer 14 and the surface of the sprayed film 16 so that the surface of the build-up layer 14 and the surface of the sprayed film 16 connect to each other in a smooth fashion in the plug 10. Therefore, it is less likely that flaws occur in the inner surface of a hollow blank which is obtained by piercing-rolling the billet 36.

Generally, a plug to be used in a piercing machine for piercing-rolling a billet includes a rolling portion and a reeling portion. The rolling portion takes charge of a major part of the rolling reduction of wall thickness. The reeling portion finishes the wall thickness in a smooth fashion. In the example shown in FIG. 1, the first body portion 22 and the build-up layer 14 which covers the surface of the first body portion 22 correspond to a rolling portion 101, and the second body portion 24 and the sprayed film 16 which covers the surface of the second body portion 24 correspond to the reeling portion 102. However, such correspondence is not necessarily required. In short, the build-up layer 14 may be formed in a portion which is susceptible to melting loss when piercing-rolling the billet 36. The portion susceptible to melting loss is the rolling portion. The portion which is particularly susceptible to melting loss is the front end portion of the rolling portion, and a portion in the rolling portion which is opposed to a gorge portion 321 of a skew roll 32 (a portion opposed to the gorge portion in the direction orthogonal to the pass line PL). As shown in FIG. 3, the spacing between a pair of skew rolls 32, 32 is shortest between the gorge portions 321, 321 (at a position GL shown by a chain line in FIG. 3). Generally, melting loss is likely to occur in a width WP of several centimeters forward and backward (for example, 3 cm forward and backward, respectively) in the pass line direction from the position GL opposed to the gorge portion 321 in the rolling portion. Therefore, the build-up layer 14 is preferably formed in an area which covers at least from the front end of the plug to a position at a predetermined distance (for example, 3 cm) backward from the position GL. Note that the build-up layer 14 is preferably not formed in the reeling portion from the viewpoint of the prevention of scoring of the plug.

In FIG. 1, the sprayed film 16 is formed on the entire surfaces of the second body portion 24 and the rear end portion 26. However, as described above, it is enough for the sprayed film 16 to cover at least an area from the rear end of the build-up layer 14 to a position of the maximum outer diameter of the plug body 12.

Second Embodiment

The plug according to an embodiment of the present invention may have a build-up layer formed on the surface of the body portion. Such an implementation is shown in FIG. 4.

Figure 4:
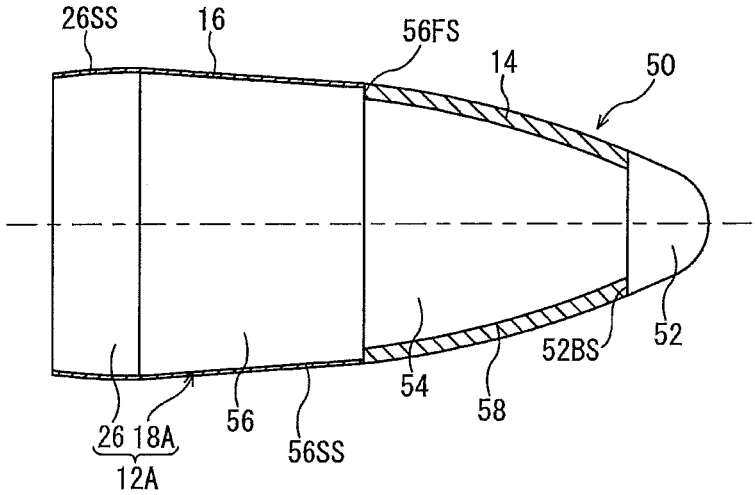
FIG. 4 is a longitudinal sectional view of a plug according to a second embodiment of the present invention.

FIG. 4 shows a plug 50 according to a second embodiment of the present invention. The plug 50 is used for piercing-rolling a hollow billet. That is, the plug 50 is used for an elongator (second piercing machine). In other words, piercing machines for which the plug 50 may be used include elongators.

The plug 50 includes a plug body 12A instead of the plug body 12. The plug 12A includes, instead of the first body portion 22 and second body portion 24, a first body portion 52, a second body portion 54 and a third body portion 56.

The first body portion 52 includes the front end portion of the plug body 12A. The cross-section of the first body portion 52 is of a circular shape. The outer diameter of the first body portion 52 increases from the front end toward the rear end of the plug 50.

The second body portion 54 extends in the axial direction of the plug 15 from the rear end of the first body portion 52. The cross section of the second body portion 54 is of a circular shape, and the outer diameter of the front end of the second body portion 54 is smaller than the outer diameter of the rear end of the first body portion 52. The second body portion 54 is disposed coaxially with the first body portion 52. As a result, a step height will be formed at the boundary between the second body portion 54 and the first body portion 52. A rear end surface 52BS of the first body portion 52 has an annular shape. The outer diameter of the second body portion 54 increases from the front end toward the rear end of the plug 50.

The third body portion 56 has an outer diameter larger than that of the rear end of the second body portion 54. The third body portion 56 extends in the axial direction of the plug 50 from the rear end of the second body portion 54. The cross section of the third body portion 56 is of a circular shape, and the outer diameter of the front end of the third body portion 56 is larger than the outer diameter of the rear end of the second body portion 54. The third body portion 56 is disposed coaxially with the second body portion 54. As a result, a step height will be formed at the boundary between the third body portion 56 and the second body portion 54. A front end surface 56FS of the third body portion 56 has an annular shape. The outer diameter of the third body portion 56 increases from the front end toward the rear end of the plug 50. The outer diameter of the rear end of the third body portion 56 is the maximum outer diameter of the plug body 12A. A rear end portion 26 is provided rearward of the third body portion 56 adjacent to the third body portion 56.

A recess groove 58 is formed between the first body portion 52 and third body portion 56. The recess groove 58 extends around the central axis of the plug body 12A. The bottom surface of the recess groove 58 is formed by the surface of the second body portion 54. In the present embodiment, the build-up layer 14 covers the entire bottom surface of the recess groove 58. The build-up layer 14 is located to get into contact with the billet when a hollow billet is piercing-rolled.

In the implementation shown in FIG. 4, the outer diameter of the front end of the sprayed film 16 is the same as the outer diameter of the rear end of the build-up layer 14. That is, the surface of the build-up layer 14 and the surface of the sprayed film 16 connect to each other in a smooth fashion. The sprayed film 16 covers the side surface 56SS of the third body portion 56 and the side surface 26SS of the rear end portion 26.

In the implementation shown in FIG. 4, the outer diameter of the rear end of the first body portion 52 is the same as the outer diameter of the front end of the build-up layer 14. That is, the surface of the build-up layer 14 and the surface of the first body portion 52 connect to each other in a smooth fashion.

In the plug 50 described above, too, melting loss of the plug body is suppressed by the build-up layer, and scoring is suppressed by the sprayed film. Thus the life of the plug 50 will be extended.

Examples

Plugs of test numbers 1 to 20 shown in Table 1 were prepared.

[Plug]

Referring to Table 1, in the plugs of test numbers 1 to 11, a build-up layer was formed in a rolling portion 101 and a sprayed film was formed in portions (a reeling portion 102 and a relief portion 103) other than the rolling portion 101 as shown in FIG. 1. The build-up layers of test numbers 2 to 6 and 8 to 11 contained a carbide (NbC or WC) by the content shown in Table 1. The build-up layers of test numbers 1 and 7 did not contain any carbide. Any of the build-up layers of test numbers 1 to 11 was formed by the PTA process. The thickness of any of the build-up layers was 3.0 mm.

Any of the sprayed films of test numbers 1 to 11 was made up of iron and iron oxides, and was formed by arc spraying an iron wire rod at the same condition. The content rate of iron oxides in the sprayed film was 70%, and the thickness of any of the sprayed films was 400 μm.

In the plugs of test numbers 12 to 18, a protection film 202 was formed on the entire surface of the plug body 201 excepting the rear end surface as shown in FIG. 4. In test numbers 12 to 16, the protection film 202 was a build-up layer. These build-up layers were formed by the PTA process, and the thickness was 3.0 mm in any of them.

In test numbers 17 and 18, the protection film 202 was a sprayed film. The sprayed film was formed by the same method as that for the sprayed film of test numbers 1 to 11, and was made up of iron and iron oxides. The content rate of the iron oxides and the thickness of the sprayed film were both the same as those of test numbers 1 to 11.

Figure 5:
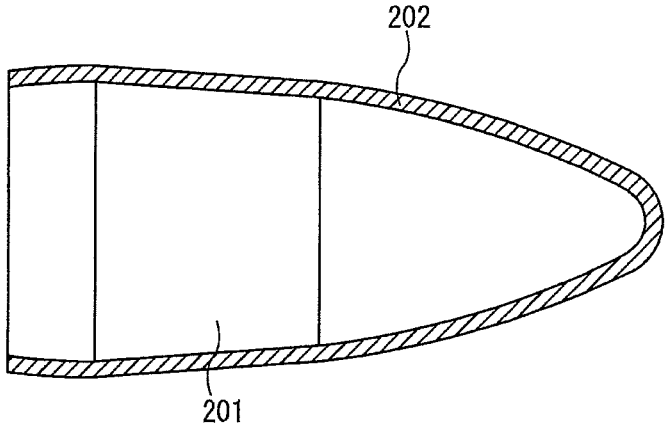
FIG. 5 is a longitudinal sectional view of a plug relating to test numbers 12 to 18.
Figure 6:
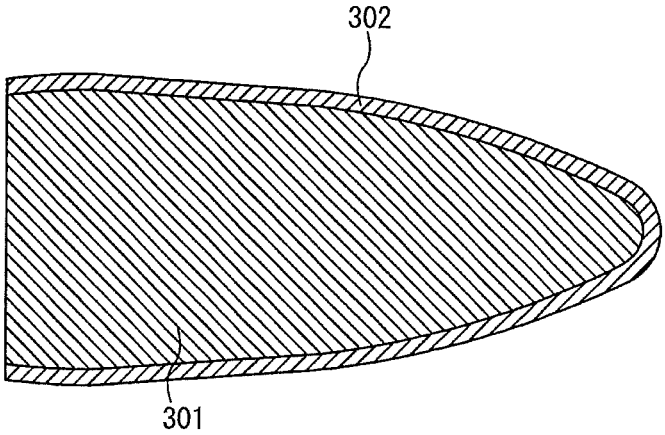
FIG. 6 is a longitudinal sectional view of a plug relating to test numbers 19 and 20.

In test numbers 19 and 20, an oxide scale 302 was formed on the entire surface of the plug body 301 excepting the rear end surface as shown in FIG. 5. The thickness of the oxide scale was 1000 μm for test number 19, and 500 μm for test number 20.

[Test Method]

The plugs of test numbers 1 to 20 were used to piercing-roll a plurality of billets. Each billet had a chemical composition corresponding to SUS310S of the JIS standard, an outer diameter of 70 mm, and a length of 100 mm.

Every time one billet was rolled, the plug surface was visually observed to confirm the presence or absence of melting loss and scoring. When melting loss or scoring occurred on the plug surface after the rolling of the n-th billet (n is a natural number), the number of billets that the plug could roll

TABLE 1

| Test number | Rolling portion | Content (mass %) of carbide | Portion excepting rolling portion | Number of passes |
|---|---|---|---|---|
| 1 | Stellite 6 Alloy | 0 | Fe sprayed film | 6 |
| 2 | SteRite 6 Alloy + NbC | 20 | Fe sprayed film | 7 |
| 3 | Stellite 6 Alloy + NbC | 35 | Fe sprayed film | 8 |
| 4 | SteRite 6 Alloy + NbC | 50 | Fe sprayed film | 8 |
| 5 | Stellite 6 Alloy + WC | 25 | Fe sprayed film | 7 |
| 6 | Stellite 6 Alloy + WC | 50 | Fe sprayed film | 8 |
| 7 | Stellite 21 Alloy | 0 | Fe sprayed film | 6 |
| 8 | Stellite 21 Alloy + NbC | 20 | Fe sprayed film | 7 |
| 9 | Stellite 21 Alloy + NbC | 35 | Fe sprayed film | 8 |
| 10 | Stellite 21 Alloy + WC | 25 | Fe sprayed film | 7 |
| 11 | Stellite 21 Alloy + WC | 50 | Fe sprayed film | 8 |
| 12 | Stellite 6 Alloy | 0 | Stellite 6 Alloy | 1 |
| 13 | Stellite 6 Alloy + NbC | 35 | Stellite 6 Alloy + NbC | 2 |
| 14 | Stellite 6 Alloy + NbC | 50 | Stellite 6 Alloy + NbC | 1 |
| 15 | Stellite 6 Alloy + WC | 25 | Stellite 6 Alloy + WC | 1 |
| 16 | Stellite 6 Alloy + WC | 50 | Stellite 6 Alloy + WC | 2 |
| 17 | Fe sprayed film | — | Fe sprayed film | 2 |
| 18 | Fe sprayed film | — | Fe sprayed film | 3 |
| 19 | Oxide scale | — | Oxide scale | 2 |
| 20 | Oxide scale | — | Oxide scale | 1 |

(hereafter, referred to as the number of passes) was defined to be n−1. Further, when the plug got stuck to a billet without penetrating it during the course of the piercing-rolling of the n-th billet, it was defined that the number of passes was n−1.

[Test Results]

Table 1 shows test results.

In test numbers 1 to 11, the number of passes was as many as not less than 6. Particularly, in test numbers 2 to 6 and 8 to 11, the carbide content in the build-up layer was 20% to 50%. As a result, the number of passes was large compared with in test numbers 1 and 7 which contain no carbide. Further, in test numbers 3, 4, 6, 9, and 11, the carbide content in the build-up layer was 35% to 50%. As a result, the number of passes was larger compared with in test numbers 2, 5, 8, and 10 in which the carbide content was less than 35%. Moreover, in test numbers 1 to 11, since a crack occurred in any of the build-up layers, the test was ended.

Meanwhile, in test numbers 12 to 16, the number of passes was as few as not more than two. Since the build-up layer was formed on the entire plug body in those test numbers, the plug got stuck to a billet without penetrating it during piercing-rolling when the number of passes according to Table 1 was exceeded.

In test numbers 17 to 20, the number of passes was as low as not more than 3. In these test numbers, a sprayed film or an oxide scale was formed on the entire plug body. As a result of that, the front end portion of the plug underwent melting loss.

Although embodiments of the present invention have been described so far in detail, these are strictly for the purpose of exemplification and the present invention will not be limited in any way by the above described embodiments.

The invention claimed is:

1. A piercing machine for piercing-rolling a billet, the piercing machine comprising:

a plug;

a mandrel having a front end, the plug being attached to the front end; and a pair of skew rolls located opposite to each other, the plug being located between the skew rolls;

the plug comprising:

a plug body;

a build-up layer formed on a surface of the plug body, the build-up layer located at least in an area between a front end portion of the plug body and a position 3 cm backward of a position opposite to a portion at which a spacing between the pair of skew rolls is shortest; and a sprayed film covering at least an area ranging from a rear end of the build-up layer to a position of a maximum outer diameter of the plug body.

2. The plug according to claim 1, wherein the plug body further comprises:

a first body portion including the front end portion; and a second body portion having an outer diameter larger than that of a rear end of the first body portion, and extending from the rear end of the first body portion, wherein the build-up layer is formed on the surface of the first body portion, and the sprayed film is formed on the surface of the second body portion.

3. The plug according to claim 1, wherein the surface of the build-up layer and the surface of the sprayed film connect to each other in a smooth fashion.

4. The plug according to claim 1, wherein the build-up layer contains a carbide.

* * * * *